US006347975B2

(12) United States Patent
Ishizaki et al.

(10) Patent No.: US 6,347,975 B2
(45) Date of Patent: Feb. 19, 2002

(54) APPARATUS AND METHOD FOR PROCESSING THIN-FILM MAGNETIC HEAD MATERIAL

(75) Inventors: Kazuo Ishizaki; Hiroyuki Itoh, both of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/742,060

(22) Filed: Dec. 22, 2000

(30) Foreign Application Priority Data

Jan. 13, 2000 (JP) ..... 2000-005054

(51) Int. Cl.[7] ..... B24B 49/00
(52) U.S. Cl. ..... 451/5; 451/8; 451/9; 451/410
(58) Field of Search ..... 451/5, 9, 285–290, 451/8, 410; 29/603; 51/165, 165.71, 165.74, 165.76, 165.77

(56) References Cited

U.S. PATENT DOCUMENTS

| | | | | |
|---|---|---|---|---|
| 4,912,883 A | * | 4/1990 | Chang et al. | 451/5 X |
| 4,914,868 A | | 4/1990 | Church et al. | |
| 5,478,270 A | * | 12/1995 | Cuomo et al. | 451/5 |
| 5,525,091 A | * | 6/1996 | Lam et al. | 451/5 X |
| 5,609,511 A | * | 3/1997 | Moriyama et al. | 451/5 |
| 5,816,895 A | * | 10/1998 | Honda | 451/5 X |

FOREIGN PATENT DOCUMENTS

| | | |
|---|---|---|
| JP | 2-95572 | 4/1990 |
| JP | 11-863 | 1/1999 |
| JP | 11-213337 | 8/1999 |

OTHER PUBLICATIONS

U.S. Application No. 09/733,936, filed Dec. 12, 2000, Ishizaki et al.

* cited by examiner

*Primary Examiner*—Derris H. Banks
*Assistant Examiner*—Anthony Ojini
(74) *Attorney, Agent, or Firm*—Oliff & Berridge, PLC

(57) ABSTRACT

An apparatus main body has a surface plate, a vertical shaft and an arm coupled to the vertical shaft such that it can move in the vertical direction. A spline shaft is attached to the arm such that it can move in the vertical direction. A keeper for holding a workpiece is attached to the lower end of the spline shaft. To the arm, attached are: reference position sensor for detecting the position of the top surface of a reference base as a reference position; and a workpiece thickness sensor for detecting the position of the top surface of the keeper as a position associated with the thickness of the workpiece. During a process on the workpiece, the absolute thickness of the workpiece is recognized based on information detected by the sensors, and the processing operation is controlled such that the thickness will become a desired value.

20 Claims, 17 Drawing Sheets

APPARATUS AND METHOD FOR PROCESSING THIN-FILM MAGNETIC HEAD MATERIAL

BACKGROUND OF THE INVENTION

1. Field of the Invention

The present invention relates to an apparatus and method for processing a thin-film magnetic head material that are used for polishing a thin-film magnetic head material having a row of sections to become sliders each of which includes a thin-film magnetic head element.

2. Description of the Related Art

In general, a flying-type thin-film magnetic head used in a magnetic disk drive or the like is constituted by a slider having a thin-film magnetic head element at a rear end thereof. In general, the slider has a rail section whose surface serves as a medium facing surface (an air bearing surface) and a tapered section or step portion in the vicinity of the end on an air inflow side thereof. The rail section is slightly floated above the surface of a recording medium such as a magnetic disk by a stream of air that flows in through the tapered section or step section.

In general, such sliders are manufactured by cutting a wafer in one direction, the wafer having a plurality of rows of sections to become sliders (hereinafter referred to as slider sections) each including a thin-film magnetic head element. Materials referred to as "bars" on which the slider sections are arranged in a row are thereby formed. The bars are then cut into sliders. A surface of a bar which is to become a medium facing surface (hereinafter referred to as "medium facing surface" for convenience) is subjected to processes such as lapping and formation of a rail portion. Such process may be performed before or after the formation of the bar.

In the process of manufacturing a slider as described above, the ultimate thickness of the slider or the profile of the medium facing surface may be controlled by lapping the surface of the bar opposite to the medium facing surface before or after the processing of the medium facing surface of the bar, or by lapping two surfaces of a block in which two rows of slider sections are arranged such that the medium facing surfaces thereof face each other, the two surfaces of the block being opposite to the medium facing surfaces.

Two methods as described below have been available for lapping the surface of the above-described thin-film magnetic head material as described above opposite to the medium facing surface (hereinafter referred to as "back surface").

A first method is to lap the back surface before lapping the medium facing surface. This method is primarily employed when a material in the form of a block is used in which two rows of slider sections are arranged such that the medium facing surfaces face each other. When such a material is used, a double-side lapping apparatus is frequently used to lap both sides of the material.

A second method is to lap the back surface after lapping the medium facing surface. This method is employed when using a bar formed by cutting a wafer in one direction, in which a plurality of rows of slider sections are aligned and oriented, for example, in the same direction. This method is often conducted by bonding the back surface of the bar to an appropriate jig, lapping the medium facing surface of the bar, removing the bar from the jig thereafter and bonding the medium facing surface of the bar to the jig to lap the back surface of the bar.

In either of the above-described two methods, the process (lapping) must be controlled such that the thickness of the material which is a workpiece attains a desired value. In order to control the thickness of the material, the processing time is controlled, for example, in prior art. Referring to the processing operation in such a case, the operator measures the thickness of the material and accordingly sets a processing time in the processing apparatus. In order to improve accuracy in processing, after starting the processing operation the operator measures the thickness of the material and adjusts the processing time once or more times by interrupting the process each time.

Recently, there are needs for compact sliders which are floated by only a small amount in order to achieve high density recording. The accuracy of the thickness of a thin-film magnetic head material has a significant influence not only on the accuracy of the thickness of the slider but also on the accuracy of the formation of a rail on the slider. Therefore, in order to provide a compact slider which is floated by only a small amount, the thickness of the thin-film magnetic head material must be accurately controlled.

In the case of above-described method in which the back surface of the thin-film magnetic head material is processed by controlling the processing time, however, the processing accuracy is low because there is significant variation in processing depending on the state of the surface plate, slurry and the like and on the operator. This results in a problem in that it is difficult to accurately control the thickness of the thin-film magnetic head material. Further, it has a problem in that an operator must repeat the measurement of the thickness of the material and processing of the same many times to improve processing accuracy, which increases the number of steps and reduces operating efficiency.

Especially, when the back surface of the bar is lapped after lapping the medium facing surface, the above-mentioned reduction in operating efficiency is significant because there are increased number of lapping steps compared to lapping of both sides of a material in the form of a block in which slider sections are arranged in two rows. Further, when the back surface of the bar is lapped after lapping the medium facing surface thereof, the measurement of thickness of the material and processing of the same repeated many times result in a problem in that the lapped medium facing surface may deteriorate and in that a thin film such as a GMR (giant magnetoresistive) film may be broken by electrostatic discharge (ESD).

OBJECTS AND SUMMARY OF THE INVENTION

It is a first object of the invention to provide an apparatus and a method for processing a thin-film magnetic head material which make it possible to improve the accuracy and efficiency of a process of polishing the material.

In addition to the first object, it is a second object of the invention to provide an apparatus and a method for processing a thin-film magnetic head material which make it possible to polish the surface of the material opposite to the medium facing surface thereof while protecting the medium facing surface.

An apparatus for processing a thin-film magnetic head material according to the invention comprises:

- a processing machine which performs a polishing process on a thin-film magnetic head material in which sections to become sliders each including a thin-film magnetic head element are arranged in a row;
- a first detector which detects a reference position;

a second detector which detects a position which changes depending on the thickness of the material; and a controller which recognizes the thickness of the material based on the reference position detected by the first detector and the position detected by the second detector and controls the processing machine such that the thickness of the material becomes a predetermined value.

In the apparatus according to the invention, the first detector detects the reference position; the second detector detects the position which changes depending on the thickness of the material; and the controller recognizes the thickness of the material based on the positions detected by the two detectors and controls the processing machine such that the thickness of the material becomes the predetermined value.

In the apparatus according to the invention, the processing machine may have a rotating surface plate, and the apparatus may further comprise a processing jig for holding the material such that a surface of the material to be polished is put into contact with the surface plate.

The processing jig may hold the material having a band-shaped protective member applied to a surface thereof opposite to the surface to be polished. The processing jig may have: a first member having a hole at a lower end thereof, the hole allowing the material to pass therethrough and disallowing the protective member to pass therethrough; and a second member coupled to the first member, the first and second members sandwiching the protective member therebetween.

The first member may have a plurality of the holes described above. As the first member, a plurality of types of the first members may be provided which are different from each other in at least either the length or position of the hole thereof. The position of an outermost end of the hole may be uniformly set for the plurality of types of the first members.

In the apparatus according to the invention, a plurality of types of processing jigs may be provided as the processing jig described above, each of the processing jigs having a position regulating section for placing the material in a predetermined position. The jigs are different from each other in at least either the length or position of the position regulating section thereof. The position of an outermost end of the position regulating section is uniformly set for the plurality of types of the jigs.

In the apparatus according to the invention the first detector and the second detector may be mounted on the same arm.

In the apparatus according to the invention, the first detector and the second detector may intermittently perform the detecting operation.

In the apparatus according to the invention the controller may recognize the thickness of the material based on the result of detection carried out plural times by the first detector and the second detector.

A method according to the invention is provided for processing a thin-film magnetic head material, utilizing an apparatus for processing a thin-film magnetic head material that has: a processing machine which performs a polishing process on a thin-film magnetic head material in which sections to become sliders each including a thin-film magnetic head element are arranged in a row; a first detector which detects a reference position; and a second detector which detects a position which changes depending on the thickness of the material. The method comprises the steps of:

detecting a reference position using the first detector and detecting a position which changes depending on the thickness of the material using the second detector;

recognizing the thickness of the material based on the reference position detected by the first detector and the position detected by the second detector; and performing the processing by controlling the processing machine based on the recognized thickness of the material such that the thickness becomes a predetermined value.

In the method according to the invention, the processing machine may have a rotating surface plate; and the material may be held using a processing jig such that a surface of the material to be polished is put into contact with the surface plate in the step of performing the processing.

In the method according to the invention, the processing jig may hold the material having a band-shaped protective member applied to a surface thereof opposite to the surface to be polished; and the processing jig may have: a first member having a hole at a lower end thereof, the hole allowing the material to pass therethrough and disallowing the protective member to pass therethrough; and a second member coupled to the first member, the first and second members sandwiching the protective member therebetween.

The first member may have a plurality of holes described above. As the first member, a plurality of types of the first members may be provided which are different from each other in at least either the length or position of the hole thereof. The position of an outermost end of the hole may be uniformly set for the plurality of types of the first members.

In the method according to the invention, a plurality of types of processing jigs may be provided as the processing jig described above, each of the processing jigs having a position regulating section for placing the material in a predetermined position. The jigs are different from each other in at least either the length or position of the position regulating section thereof. The position of an outermost end of the position regulating section is uniformly set for the plurality of types of the jigs.

In the method according to the invention, the first detector and the second detector may be mounted on the same arm.

In the method according to the invention, the detecting steps may intermittently detect the positions.

In the method according to the invention, the recognizing step may recognize the thickness of the material based on the result of detection carried out plural times by the first detector and the second detector.

Other objects, features and advantages of the invention will become sufficiently apparent from the following description.

DETAILED DESCRIPTION OF THE PREFERRED EMBODIMENT

An embodiment of the invention will now be described in detail with reference to the drawings.

Figure 1:
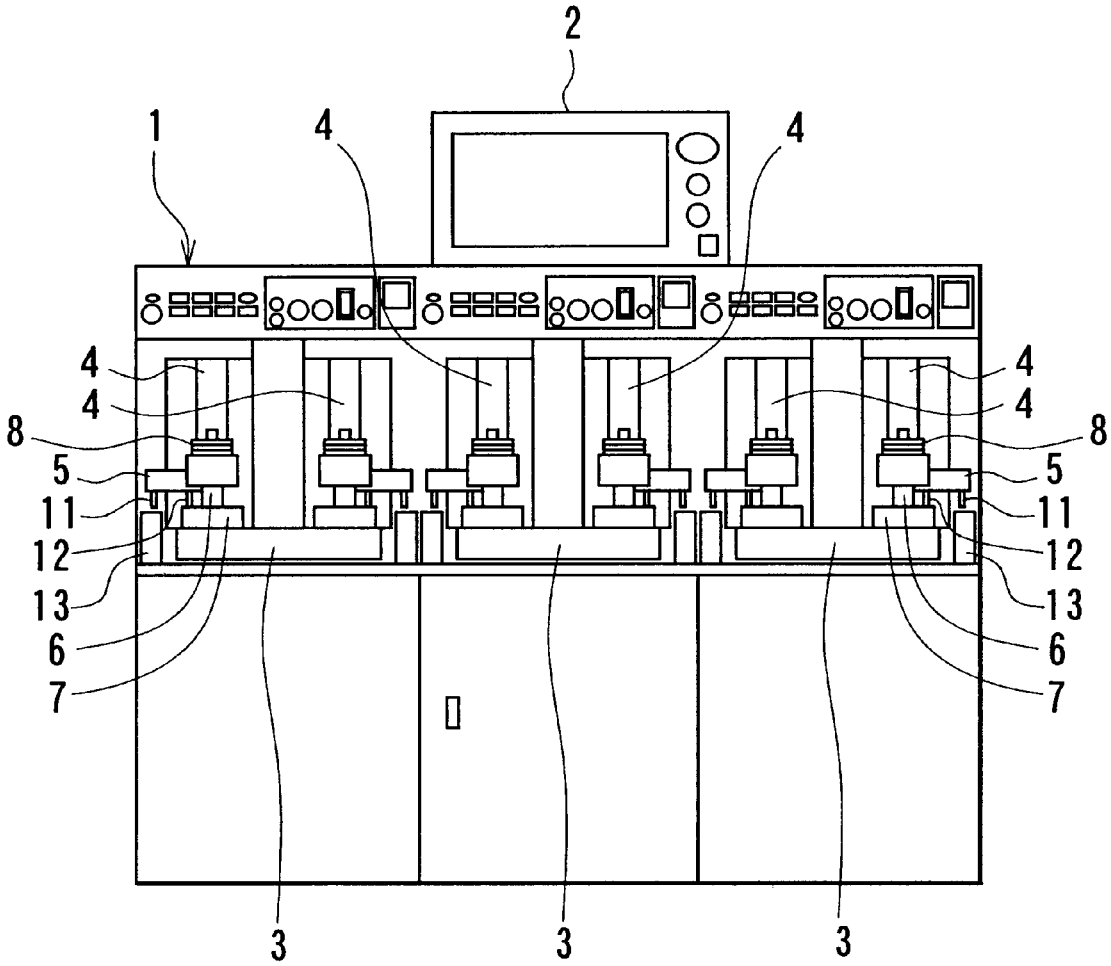
FIG. 1 is a front view of a processing apparatus according to an embodiment of the invention showing a general configuration thereof.
Figure 2:
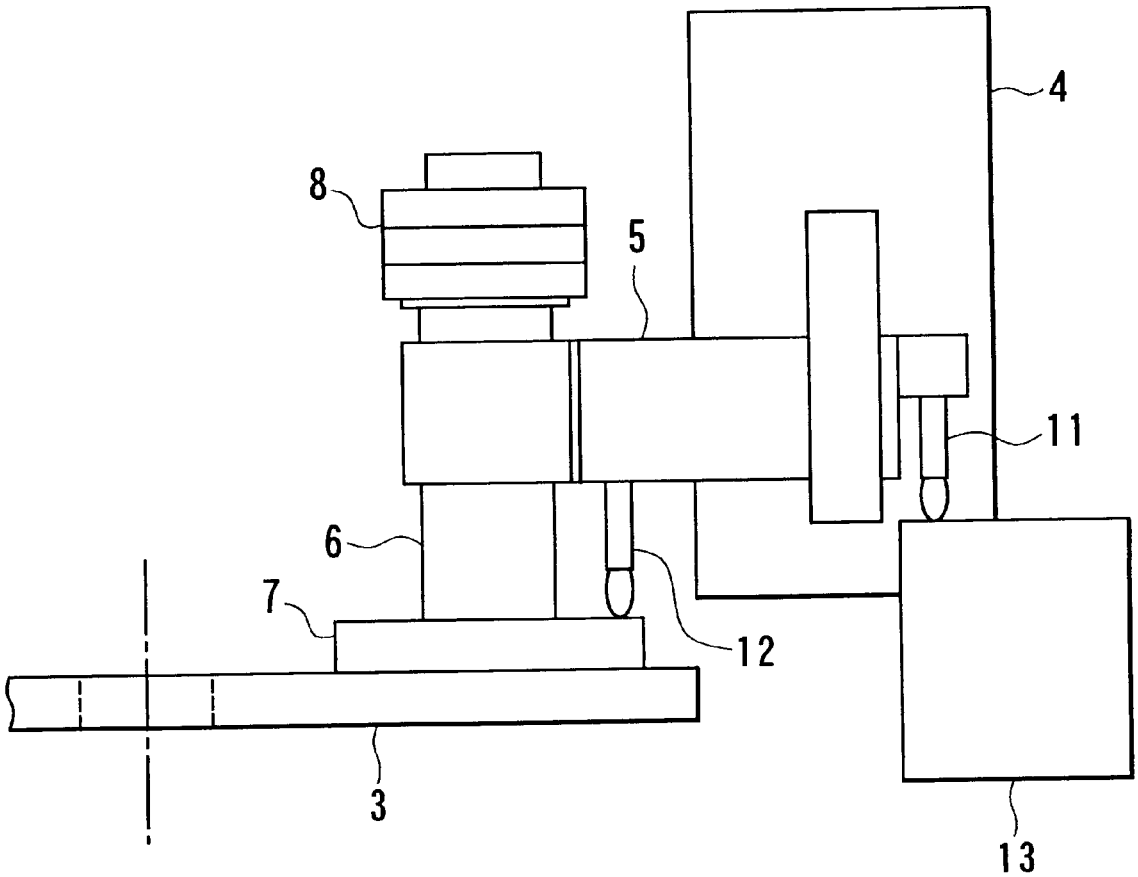
FIG. 2 is a front view of a major part of the processing apparatus according to the embodiment of the invention showing a state thereof during an adjusting operation.
Figure 3:
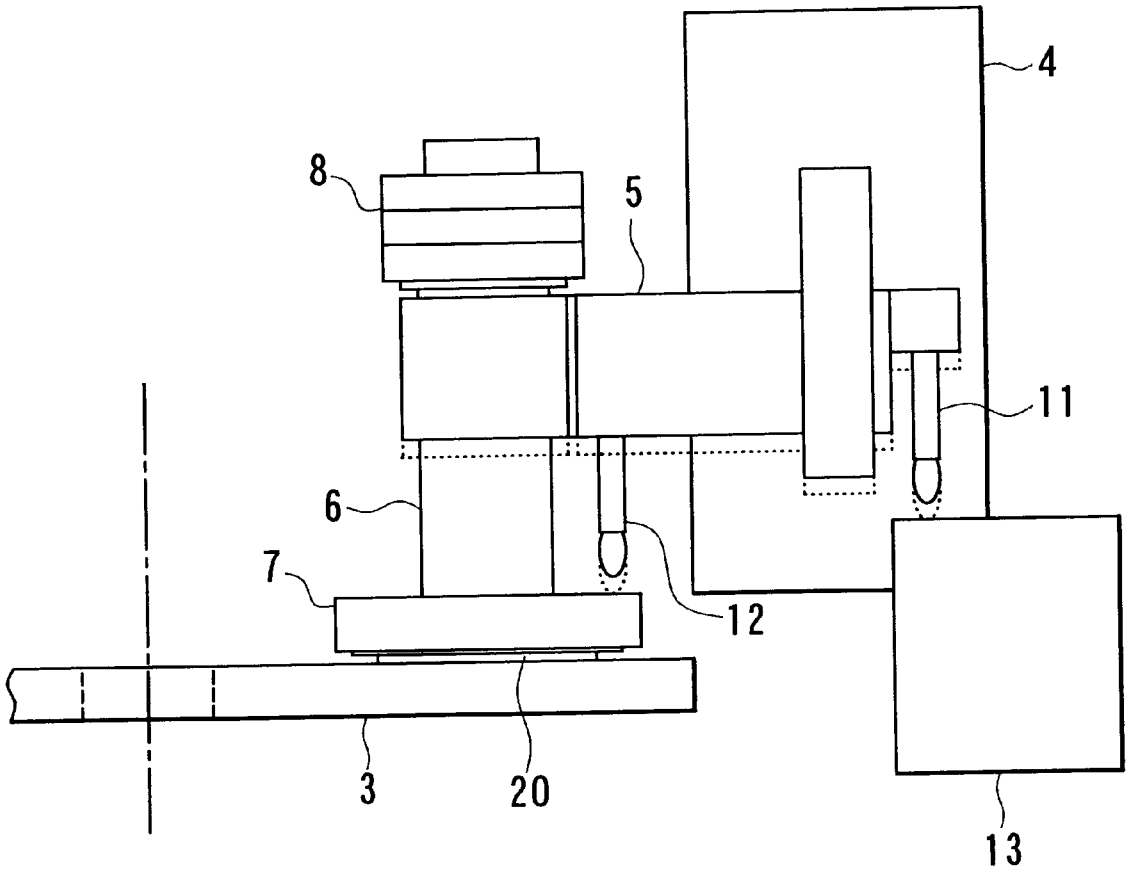
FIG. 3 is a front view of the major part of the processing apparatus according to the embodiment of the invention showing a state thereof during a processing operation.

FIG. 1 is a front view of an apparatus for processing a thin-film magnetic head material according to an embodiment of the invention (hereinafter simply referred to as "processing apparatus") showing a general configuration thereof. Each of FIGS. 2 and 3 is a front view of a major part of the processing apparatus according to the embodiment of the invention. FIG. 2 shows a state during an adjusting operation, and FIG. 3 shows a state during a processing operation.

The processing apparatus according to the present embodiment has an apparatus main body 1 for performing a polishing process on workpieces and a control panel 2 for inputting information on the workpieces and processing conditions and showing various indications. In the present embodiment, the workpiece is a thin-film magnetic head material in which sections to become sliders each including a thin-film magnetic head element (hereinafter referred to as "bars") are arranged in a row. The polishing process in the present embodiment is lapping. The apparatus main body 1 has three surface plates 3, two vertical shafts 4 provided on each surface plate 3 and an arm 5 provided on each shaft 4. The arms 5 are coupled to the vertical shafts 4 such that they can move in vertical and horizontal (forward and backward) directions.

Spline shafts 6 are attached to the arms 5 such that they can move in the vertical direction. Keepers 7 for holding workpieces are attached to the lower ends of the spline shafts 6. Weights 8 are attached to the spline shafts 6 in the vicinity of the upper ends thereof.

Reference position sensors 11 as the first detector which detects reference positions and workpiece thickness sensors 12 as the second detector which detects positions associated with thicknesses of the workpieces which change as a result of a process are attached to the arms 5. The reference position sensors 11 are provided in positions outside the periphery of the surface plates 3. The workpiece thickness sensors 12 are provided in positions above the keepers 7. Reference bases 13 in the form of blocks for indicating reference positions are provided under the reference position sensors 11. The reference position sensors 11 detect the positions of the top surfaces of the reference bases 13 as reference positions. The workpiece thickness sensors 12 detect positions of the top surfaces of the keepers 7 as the positions associated with the thicknesses of the workpieces which change as a result of a process.

The reference position sensors 11 and workpiece thickness sensors 12 may be contact type sensors or non-contact type sensors. The "TESA Modules" manufactured by TESA Corp. or the like may be used as the contact type sensor. The "Microsense" manufactured by ADE Corp. may be used as the non-contact type sensor. Sensors having good temperature characteristics are preferably used as the sensors 11 and 12 because there may be temperature changes in the vicinity of the sensors 11 and 12 during processing. For example, such sensors with good temperature characteristics include glass scale type sensors (e.g., sensors manufactured by Union Tool Corp.).

Figure 4:
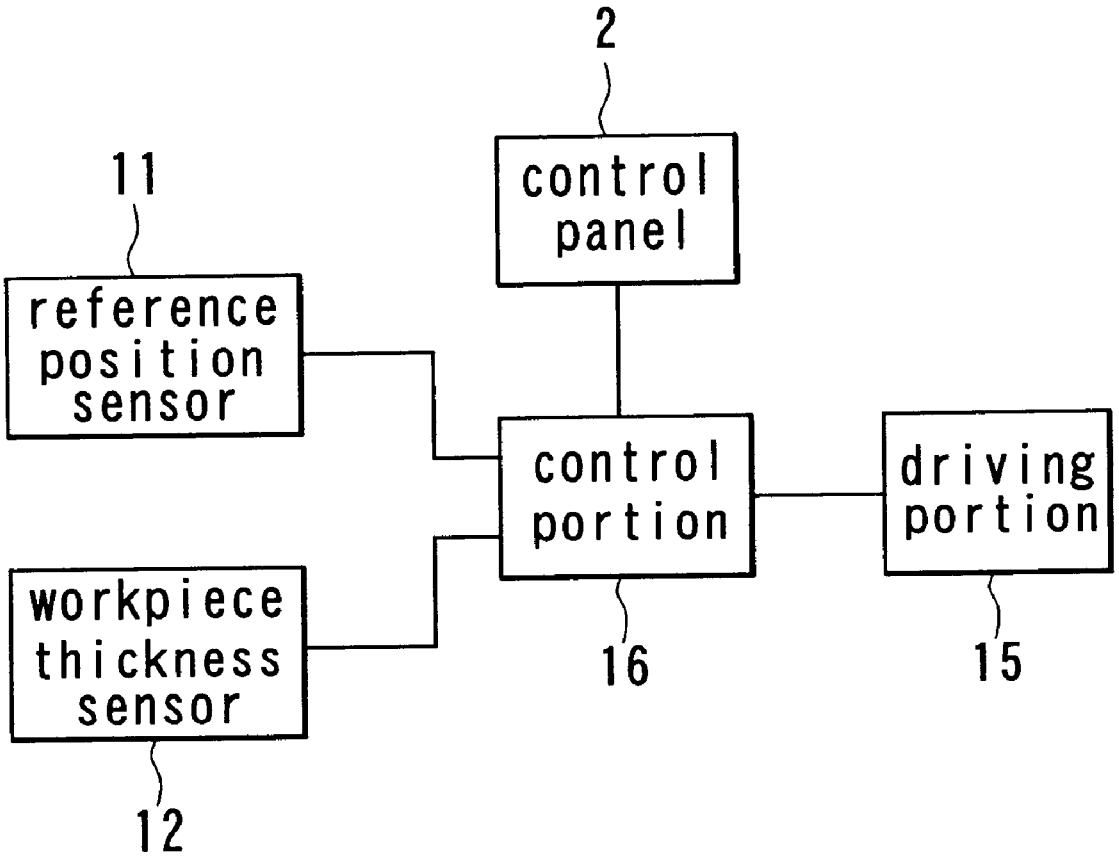
FIG. 4 is a block diagram showing a circuit configuration of the processing apparatus according to the embodiment of the invention.

FIG. 4 is a block diagram showing a circuit configuration of the processing apparatus according to the present embodiment. FIG. 4 shows only parts associated with one of the arms 5. As shown in FIG. 4, the processing apparatus has a driving portion 15 for driving the surface plate 3 and arm 5, and a control portion 16 for controlling the driving portion 15. The control panel 2, the reference position sensor 11 and the workpiece thickness sensor 12 are connected to the control portion 16. The control portion 16 controls the driving portion 15 according to information on the workpiece, processing conditions, etc. input from the control panel 2 and controls the driving portion 15 such that the thickness of the workpiece becomes a predetermined value by recognizing the thickness of the workpiece based on a reference position detected by the reference portion sensor 11 and a position detected by the workpiece thickness sensor 12. The control portion 16 also causes the control panel 2 to display information of the thickness of the workpiece and so on thus recognized. For example, the control portion 16 is constituted by a computer. The control portion 16 corresponds to the controller of the present invention.

Figure 5:
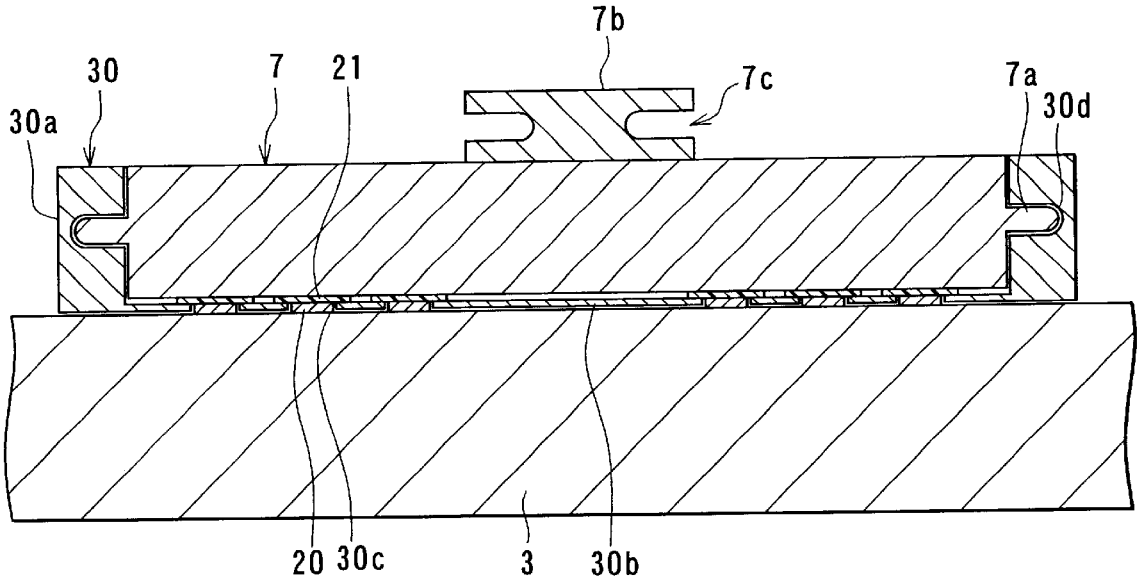
FIG. 5 is a sectional view of a processing jig in the embodiment of the invention showing a state in which a workpiece is fixed on the same.
Figure 6:
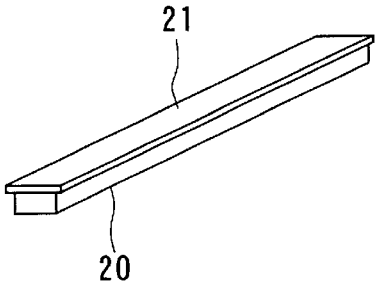
FIG. 6 is a perspective view of the workpiece in the embodiment of the invention.
Figure 7:
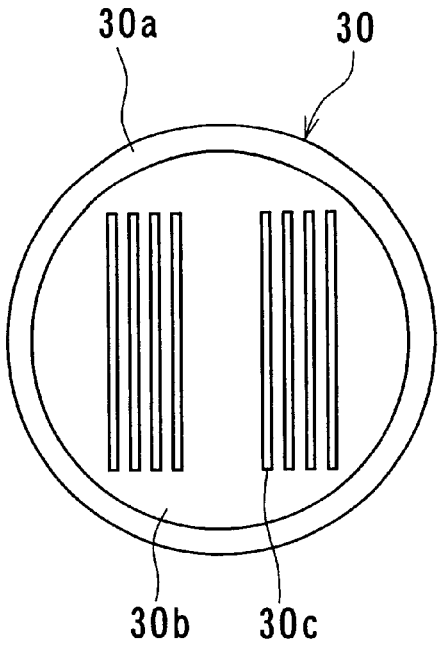
FIG. 7 is a plan view of a carrier of the processing jig in the embodiment of the invention.

A description will now be made with reference to FIGS. 5 through 7 on an operation of a processing jig in the present embodiment for holding a workpiece such that a surface of the workpiece to be polished is in contact with the surface plate 3. FIG. 5 is a sectional view showing a state in which the workpiece is fixed on the processing jig. FIG. 6 is a perspective view of the workpiece. FIG. 7 is a plan view of a carrier of the processing jig.

As shown in FIG. 6, a workpiece 20 or bar is in the form of an elongate plate. A surface (hereinafter referred to "back surface") of the workpiece 20 opposite to a surface thereof to become a medium facing surface (hereinafter referred to as "medium facing surface" for convenience) is polished by the processing apparatus according to the present embodiment. During the polishing process, the workpiece 20 is held by the processing jig with a band-shaped protective member 21 applied to the surface of the workpiece 20 opposite to the polished surface, i.e., the medium facing surface. The width of the protective member 21 is greater than the width of the workpiece 20.

The protective/member 21 has appropriate elasticity. The thickness of the protective member 21 is preferably in the range from about 90 to 150 $\mu$m. For example, a member in which an adhesive layer is stacked on a base material may be used as the protective member 21. For example, the material that constitutes the base material may be an organic material such as polyvinyl chloride (PVC), polyethylene terephthalate (PET) or a polyolefine type material. For example, the adhesive that constitutes the adhesive layer may be an organic adhesive such as a generally-used acrylic adhesive.

As the protective member 21, an ultraviolet setting tape whose adhesive layer is made of an ultraviolet (UV) setting material may be used. Such an ultraviolet setting tape may be an ultraviolet setting dicing tape "D-series" (a trade name) manufactured by LINTEC Corporation, for example. The adhesive strength of the adhesive layer of such an ultraviolet setting tape is reduced when irradiated by an ultraviolet ray. Therefore, when such an ultraviolet setting tape is used as the protective member 21, the protective member 21 can be easily peeled off from the workpiece 20 without leaving a trace of the adhesive by irradiating the protective member 21 with an ultraviolet ray.

The protective member 21 may be a thermopeeling tape whose adhesive layer is made of a termopeeling material. For example, such a thermopeeling tape may be "SKY SHEET" (a trade name) manufactured by Nikka Seiko Co., Ltd. Or "REVALPHA" (a trade name) manufactured by Nitto Denko Corporation. The adhesive strength of the adhesive layer of such a thermopeeling tape is reduced when heated. Therefore, when such a thermopeeling tape is used as the protective member 21, the protective member 21 can be easily peeled off from the workpiece 20 without leaving a trace of the adhesive by heating the protective member 21.

The protective member 21 may be an antistatic tape whose base contains a conductive substance and has an antistatic function. Such antistatic tapes include "ELEGRIP E-series" (a trade name) manufactured by TOYO CHEMICAL Co., Ltd. Through the use of such an antistatic tape as the protective member 21 to protect protecting the medium facing surfaces of the slider sections, electrostatic breakdown of the slider sections in the bar such as electrostatic breakdown of the thin-film magnetic head elements in the bar due to human handling and so on, in particular, can be prevented.

A dry film resist used for photolithography may be used as the protective member 21. For example, such dry film resists include "VANX DRY FILM PHOTORESIST U-120" (a trade name) manufactured by Fujifilm Olin Co., Ltd. When such a dry film resist is used as the protective member 21, the dry film resist may be utilized as a photoresist for forming a rail section to be described later.

As shown in FIGS. 5 and 7, the processing jig has a carrier 30 and a keeper 7. The carrier 30 has a cylindrical section 30*a* having a thick cylindrical configuration and a disc section 30*b* in the form of a disc formed to close the lower end of the cylindrical section 30*a*. The disc section 30*b* has a plurality of holes 30*c* which are sized to allow the workpieces 20 to pass therethrough and to disallow the protective members 21 to pass therethrough. The thickness of the disc section 30*b* is smaller than a desired thickness of the workpieces 20 to be achieved after the process. The workpieces 20 are inserted in the holes 30*c* of the disc section 30*b* such that the lower end faces or the surfaces to be polished thereof protrude downward from the disc section 30*b* into contact with the surface plate 3. The protective members 21 are engaged with and stopped by regions of the disc section 30*b* around the holes 30*c*.

The keeper 7 is in the form of a column having an outline slightly smaller than the inner diameter of the cylindrical section 30*a*. The keeper 7 is inserted into the cylindrical section 30*a* of the carrier 30 to hold the protective member 21 and workpiece 20, the protective member 21 being sandwiched between the lower end face of the keeper 7 and the disc section 30*b* of the carrier 30.

On the inner circumference of the cylindrical section 30*a* of the carrier 30, a plurality of engaging sections 30*d* in the form of hooks are provided which extend downward from the upper end thereof and further extend in the horizontal direction. Pins 7*a* which engage the engaging sections 30*d* of the carrier 30 are provided on the outer circumference of the keeper 7. The keeper 7 and the carrier 30 are coupled to each other as a result of the engagement between the pins 7*a* and the engaging sections 30*d*.

An attachment 7*b* which engages the lower end of the spline shaft 6 is provided in the middle of the upper end of the keeper 7. On the outer circumference of the attachment 7*b*, a plurality of engaging sections 7*c* in the form of hooks are provided which extend downward from the upper end thereof and further extend in the horizontal direction. Although not shown, a cylindrical section into which the attachment 7*b* is inserted is provided at the lower end of the spline shaft 6, and pins which engage the engaging sections 7*c* of the attachment 7*b* are provided on the inner circumference of the cylindrical section. The lower end of the spline shaft 6 and the attachment 7*b* are coupled to each other as a result of the engagement between the pins of the spline shaft 6 and the engaging sections 7*c*. A load is applied to the keeper 7 by a weight 8 through the spline shaft 6.

The carrier 30 corresponds to the first member of the present invention, and the keeper 7 corresponds to the second member of the present invention. The holes 30*c* of the carrier 30 correspond to the position regulating section of the present invention for placing the workpieces 20 in predetermined positions.

The processing jig made up of the above-described carrier 30 and keeper 7 is rotated as a result of rotation of the surface plate 3, or is forced to rotate.

The processing apparatus according to the present embodiment has a plurality of types of carriers 30 which are different from each other in at least either the lengths or positions of holes 30*c* thereof. The position (in the radial direction of carrier 30) of the outermost ends of holes 30*c* is uniformly set for the plurality of types of carriers 30. To be specific, the distance between the center of a carrier 30 and the end of a hole 30*c* closest to the circumference of the carrier 30 is the same for all of the plurality of types of carriers 30.

FIGS. 8 through 18 are plan views showing examples of the plurality of types of carriers 30. In those figures, the two-dot chain lines indicate the position of the outermost ends of holes 30*c* uniformly set for the carriers 30 as described above. In the present embodiment, the holes 30*c* are provided with four lengths $D_1$, $D_2$, $D_3$ and $D_4$ (listed in the order of decreasing lengths) in order to accommodate workpieces 20 having four different lengths.

Figure 8:
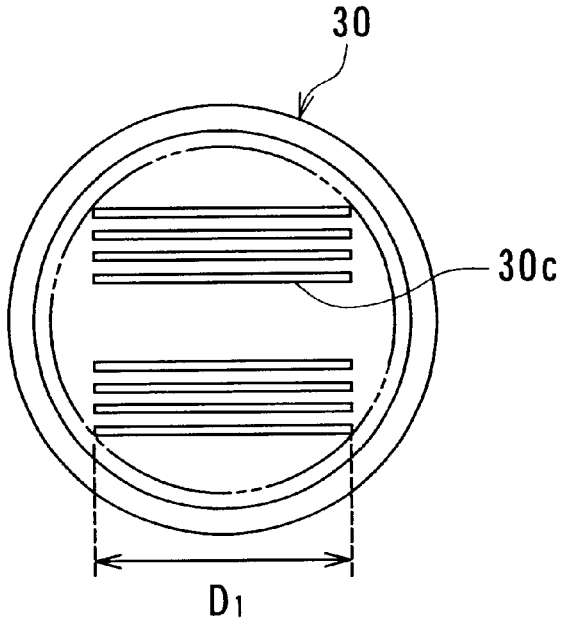
FIG. 8 is a plan view showing an example of the carrier in the embodiment of the invention.
Figure 9:
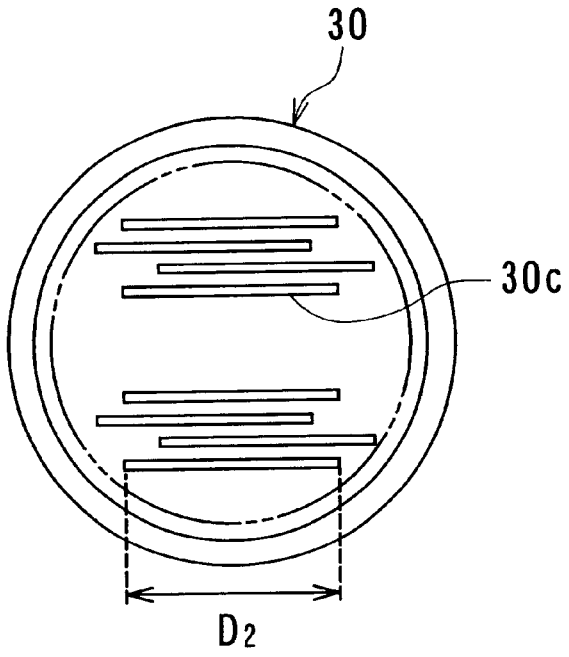
FIG. 9 is a plan view showing another example of the carrier in the embodiment of the invention.
Figure 10:
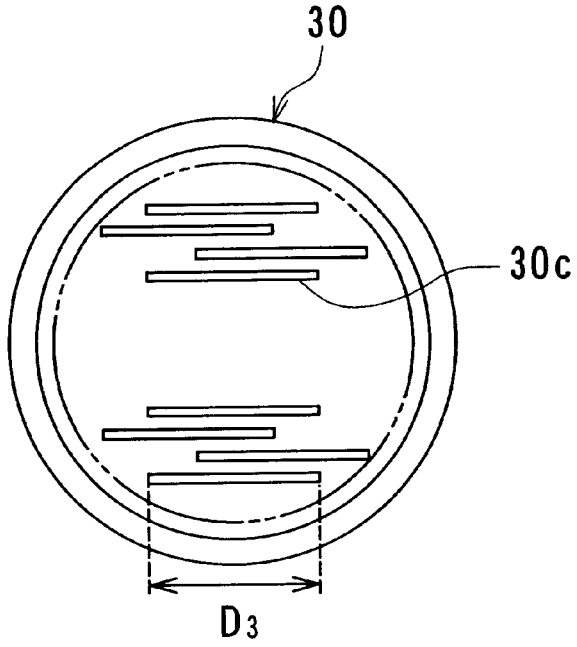
FIG. 10 is a plan view showing still another example of the carrier in the embodiment of the invention.
Figure 11:
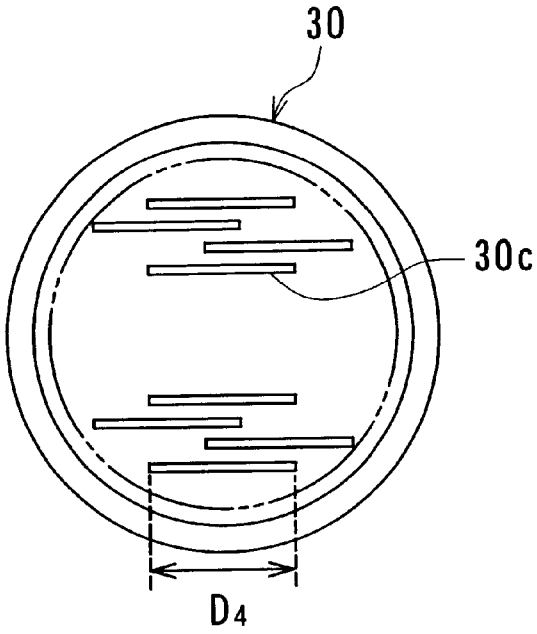
FIG. 11 is a plan view showing still another example of the carrier in the embodiment of the invention.

In the carrier 30 shown in FIG. 8, six holes 30*c* each having the length $D_1$ are provided in parallel with each other. In the carrier 30 shown in FIG. 9, eight holes 30*c* each having the length $D_2$ are provided in parallel with each other. In the carrier 30 shown in FIG. 10, eight holes 30*c* each having the length $D_3$ are provided in parallel with each other. In the carrier 30 shown in FIG. 11, eight holes 30*c* each having the length $D_4$ are provided in parallel with each other.

Figure 12:
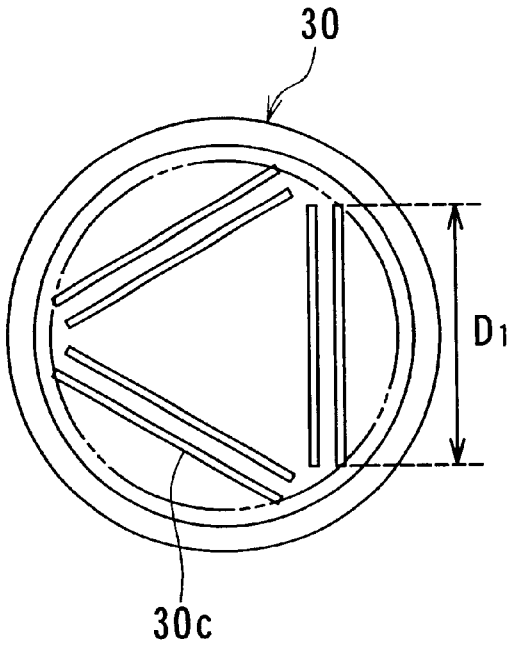
FIG. 12 is a plan view showing still another example of the carrier in the embodiment of the invention.
Figure 13:
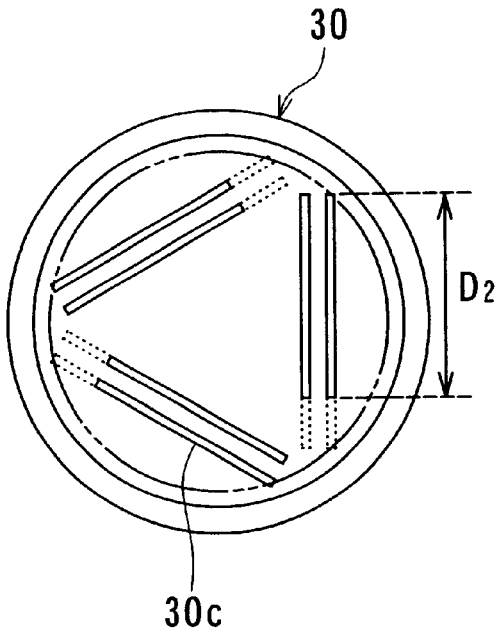
FIG. 13 is a plan view showing still another example of the carrier in the embodiment of the invention.
Figure 14:
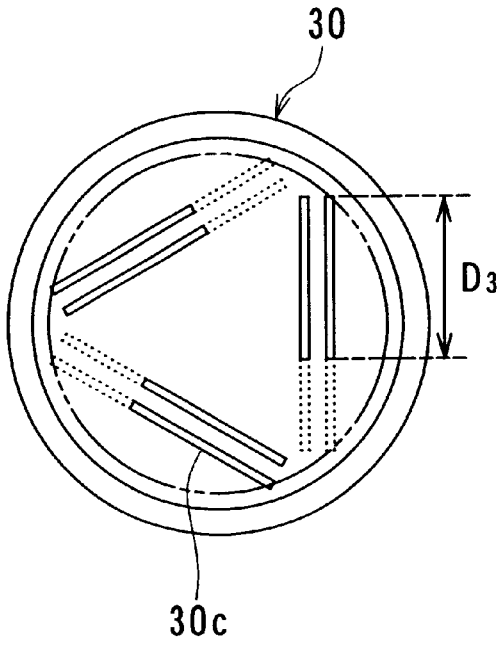
FIG. 14 is a plan view showing still another example of the carrier in the embodiment of the invention.
Figure 15:
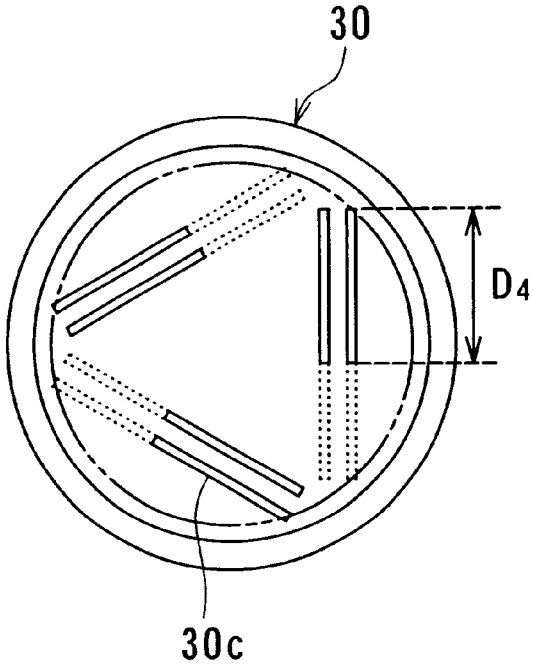
FIG. 15 is a plan view showing still another example of the carrier in the embodiment of the invention.

In the carrier 30 shown in FIG. 12, three sets of holes 30*c* are provided at an angle of 60° to each other, each set consisting of two holes 30*c* each having the length $D_1$. In the carrier 30 shown in FIG. 13, three sets of holes 30*c* are provided at an angle of 60° to each other, each set consisting of two holes 30*c* each having the length $D_2$. In the carrier 30 shown in FIG. 14, three sets of holes 30*c* are provided at an angle of 60° to each other, each set consisting of two holes 30*c* each having the length $D_3$. In the carrier 30 shown in FIG. 15, three sets of holes 30*c* are provided at an angle of 60° to each other, each set consisting of two holes 30*c* each having the length $D_4$.

Figure 16:
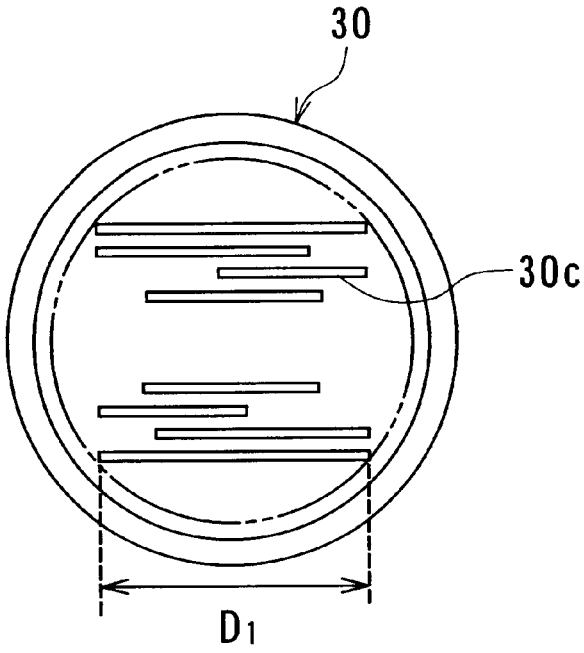
FIG. 16 is a plan view showing still another example of the carrier in the embodiment of the invention.
Figure 17:
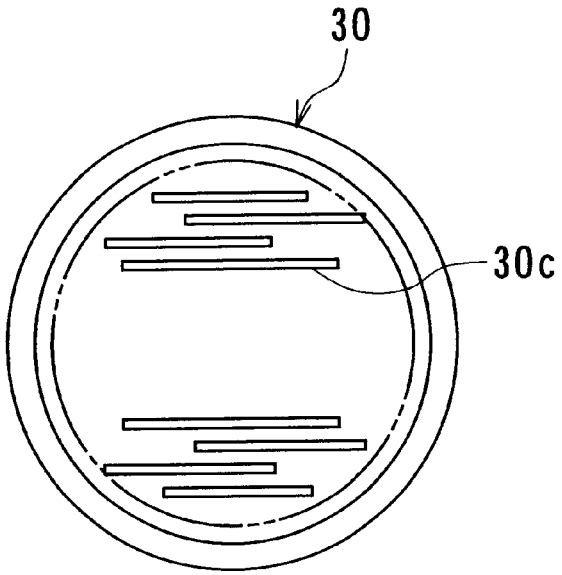
FIG. 17 is a plan view showing still another example of the carrier in the embodiment of the invention.
Figure 18:
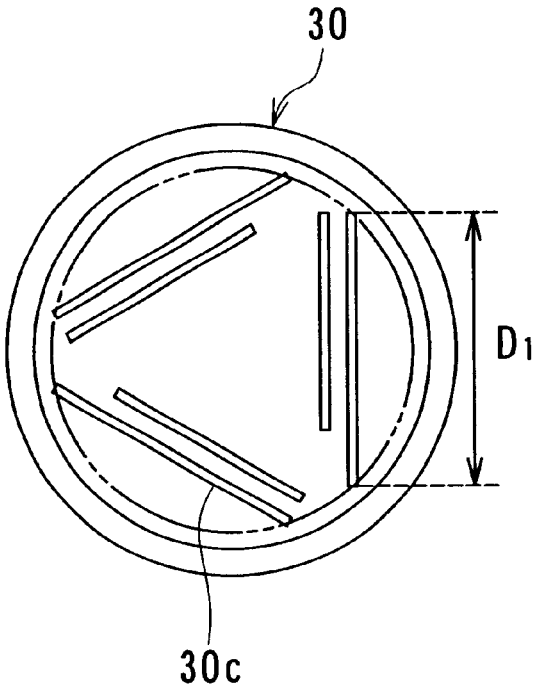
FIG. 18 is a plan view showing still another example of the carrier in the embodiment of the invention.

In the carrier 30 shown in FIG. 16, one each of four types of holes 30*c* having the lengths $D_1$ through $D_4$ respectively is provided in parallel with each other on one side of the centerline, and four holes 30*c* are similarly provided in positions in a point symmetrical relationship therewith. In the carrier 30 shown in FIG. 17, one hole 30*c* having the length $D_2$, two holes 30*c* each having the length $D_3$ and one hole 30*c* having the length $D_4$ are provided in parallel with each other on one side of the centerline, and four holes 30*c* are similarly provided in positions in a point symmetrical relationship therewith. In the carrier 30 shown in FIG. 18, three sets of holes 30*c* are provided at an angle of 60° to each other, each set consisting of one hole 30*c* having the length $D_1$ and one hole 30*c* having the length $D_2$.

A description will now be made on the operation of the processing apparatus according to the present embodiment and a method for processing a thin-film magnetic head material (hereinafter simply referred to as "processing method") according to the present embodiment. The processing apparatus according to the present embodiment performs an adjusting operation as described below before it processes a workpiece. As shown in FIG. 2, in the adjusting operation, the keeper 7 having a known reference thickness is attached to the lower end of the spline shaft 6, and the keeper 7 is put into contact with the top surface of the surface plate 3. Next, the reference position sensor 11 detects the position of the top surface of the reference base 13 as a reference position, and the workpiece thickness sensor 12 detects the position of the top surface of the keeper 7. The control portion 16 recognizes and memorizes the relative positional relationship between the reference position and the position of the top surface of the keeper 7 based on the information of the positions detected by the sensors 11 and 12. The surface plate 3 may be kept stationary or rotated when the adjusting operation is performed. However, it is preferable to rotate the surface plate 3 for the reason described later. The adjustment is not required to be carried out prior to each processing operation and may be carried out at an appropriate frequency.

For processing the workpiece, as shown in FIG. 3, the workpiece 20 held by the keeper 7 is put into contact with the surface plate 3, and the surface plate 3 is rotated to polish the workpiece 20. During the processing operation, the reference position sensor 11 detects the reference position, and the workpiece thickness sensor 12 detects the position of the top surface of the keeper 7. The control portion 16 recognizes the relative positional relationship between the reference position and the position of the top surface of the keeper 7 based on the information of the positions detected by the sensors 11 and 12. This positional relationship is compared with the positional relationship that has been recognized and memorized at the adjusting operation. The thickness of the workpiece 20 is thereby recognized.

Figure 19:
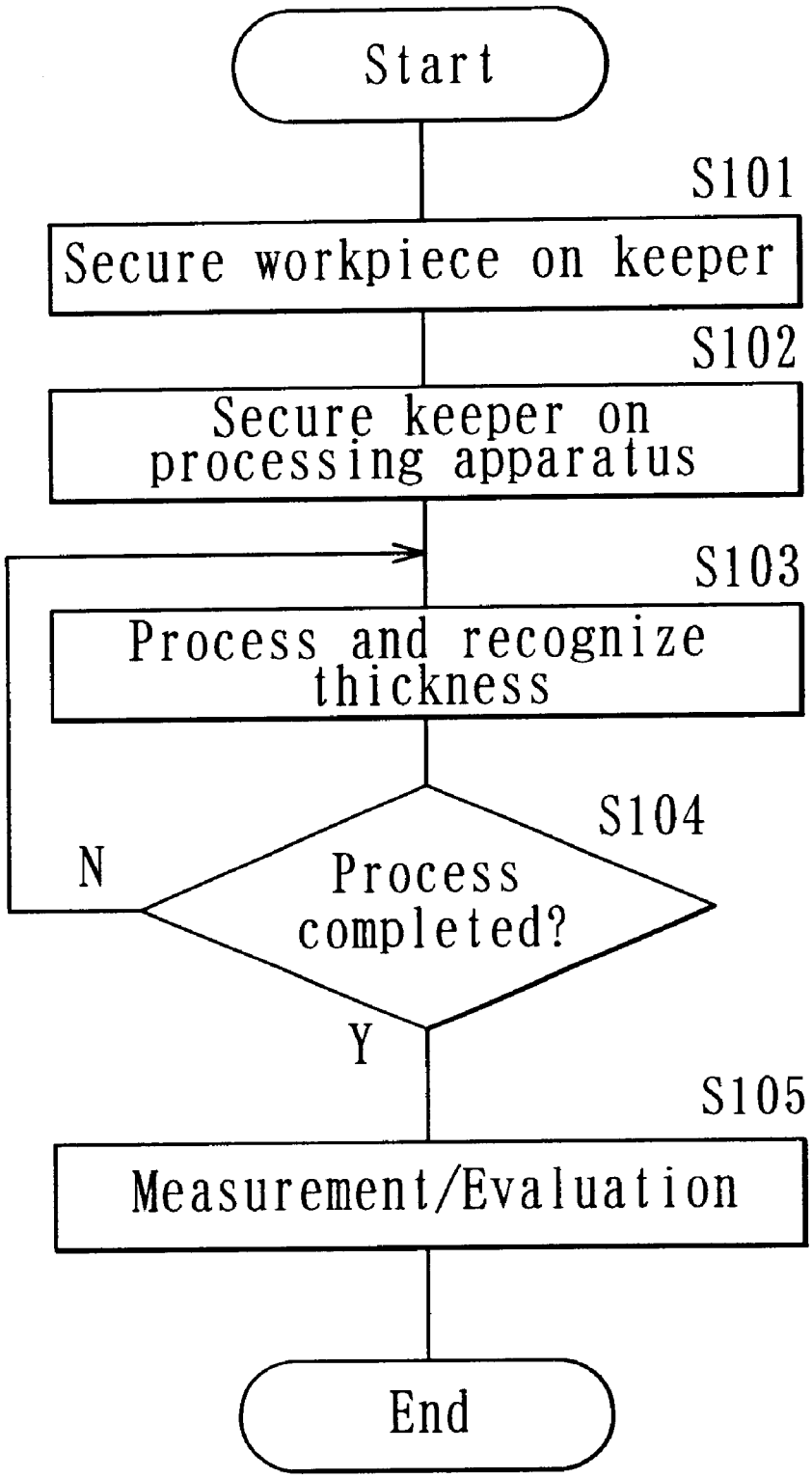
FIG. 19 is a flow chart of steps of the processing operation utilizing the processing apparatus according to the embodiment of the invention.

Steps of the processing operation will now be described with reference to the flow chart in FIG. 19 and to FIG. 3. During the processing operation, the workpiece 20 is first secured to the keeper 7 (step S101). The thickness of the keeper 7 used here is the same as that of the keeper 7 used at the adjustment and is therefore known. The keeper 7 is then secured to the processing apparatus as shown in FIG. 3 (step S102). Then, information on the workpieces such as the length and the number of the workpieces 20 and processing conditions are input using the control panel 2. The input of processing conditions includes setting of a desired thickness of the workpiece 20 after the process. Next, an operation of processing the workpiece 20 and an operation of recognizing the thickness of the same are carried out (step S103). For the processing operation, the workpiece 20 held by the keeper 7 is put into contact with the surface plate 3, and the surface plate 3 is rotated to polish the workpiece 20. During the processing operation, the control portion 16 controls the driving portion 15 according to the input information and conditions and recognizes the thickness of the workpiece 20 based on the reference position detected by the reference position sensor 11 and the position detected by the workpiece thickness sensor 12. Next, the control portion 16 determines whether the thickness of the workpiece 20 has reached the set thickness or not to determine whether to terminate the process or not (step S104). If the process is not to be terminated (N), the step S103 is continued. If the thickness of the workpiece 20 has reached the set thickness and the process is to be terminated (step S104; Y), the process by the processing apparatus is terminated. Finally, the thickness of the workpiece is measured and evaluated (step S105) to terminate the processing operation.

When the sensors 11 and 12 are non-contact type sensors, the position detection with the sensors 11 and 12 during the processing operation may be performed continuously or intermittently. When the sensors 11 and 12 are contact type sensors, the position detection with the sensors 11 and 12 during the processing operation is preferably performed intermittently to suppress the wear of the sensors 11 and 12.

When the position detection with the sensors 11 and 12 is performed intermittently, as shown in FIG. 3, the arm 5 is moved up and down to put the sensors 11 and 12 in contact with the reference base 13 and keeper 7 only when the position detection is carried out.

When the position detection with the sensors 11 and 12 is performed intermittently, the cycle of detection may be shortened stepwise as the thickness of the workpiece approaches the set value.

When the thickness of the workpiece 20 is measured based on the values detected by the sensors 11 and 12, the position detection with the sensors 11 and 12 may be performed plural times for each measurement to identify the thickness of the workpiece 20 by carrying out a calculation using a statistic technique at the control portion 16 based on a plurality of detection values. This makes it possible to recognize the absolute thickness of the workpiece 20 with improved accuracy.

For example, during the rotation of the surface plate 3, swell of the surface plate 3 and keeper 7 may cause swell in the position of the top surface of the keeper 7. In order to prevent the thickness of the workpiece 20 recognized based on the values detected by the sensors 11 and 12 from changing as a result of the swell, the thickness of the workpiece 20 may be recognized as follows. First, the adjusting operation is performed with the surface plate 3 rotated. At this time, signals indicating rotating positions of the surface plate 3 are generated, and the timing of detection with the sensors 11 and 12 is determined based on the signals to perform the position detection with the sensors 11 and 12 at a plurality of rotating positions of the surface plate 3. Thus, the absolute position of the top surface of the keeper 7 including swell or the relationship between the rotating positions of the surface plates 3 and the absolute position of the top surface of the keeper 7 is recognized. For example, the relationship is expressed by a sine curve where the rotating positions of the surface plate 3 are plotted along the abscissa axis and the absolute position of the top surface of the keeper 7 is plotted along the ordinate axis. During the processing operation, the absolute position of the top surface of the keeper 7 including swell or the relationship between the rotating position of the surface plate 3 and the absolute position of the top surface of the keeper 7 is similarly recognized by performing the position detection with the sensors 11 and 12 in a plurality of rotating positions of the surface plate 3. For example, the relationship is also expressed by a sine curve. Then, the relationship recognized during the adjusting operation is compared with the relationship recognized during the processing operation, which makes it possible to accurately recognize the absolute thickness of the workpiece 20 from which any swell component has been removed. When the relationship recognized during the adjusting operation and the relationship recognized during the processing operation are compared, corresponding parts between the relationships may be accurately identified and compared with each other by correlating the two relationships (e.g., two sine curves) or by using other means.

A description will now be made with reference to FIGS. 20 through 26 on a step for fabricating sliders from a wafer which is temporarily fabricated into bars which are the workpieces 20 in the present embodiment.

Figure 20:
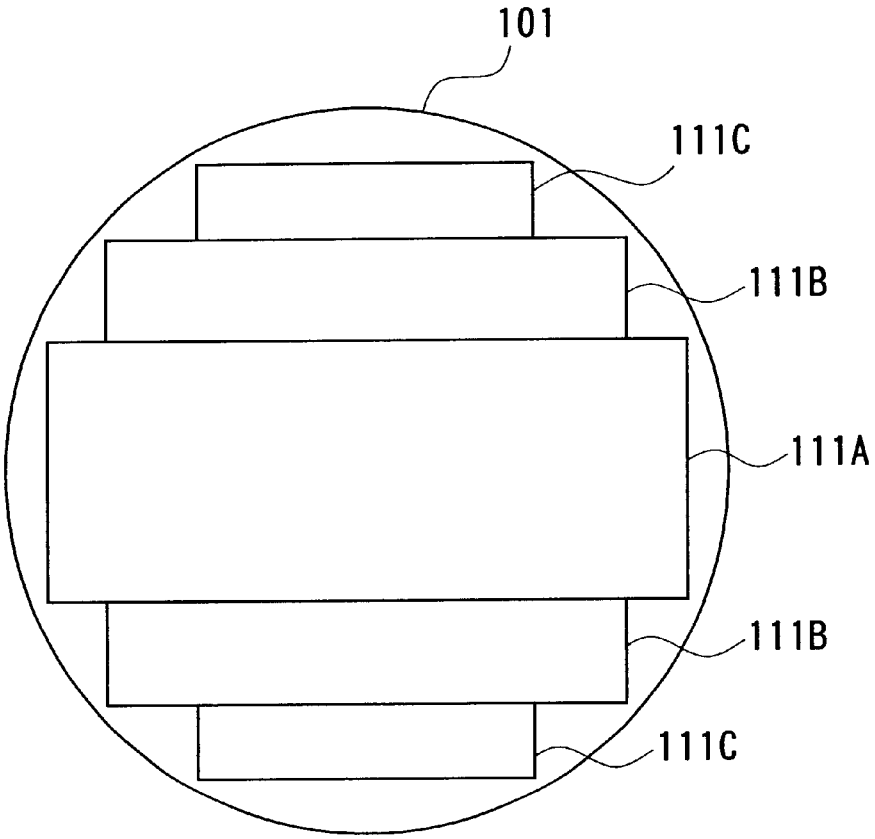
FIG. 20 is an illustration showing a step for manufacturing a slider in the embodiment of the invention.

In this step, a plurality of types of blocks having widths different from each other are cut from a disc-shaped wafer on which a plurality of rows of slider sections each including a thin-film magnetic head element are arranged. FIG. 20 shows an example a way in which the blocks are cut. In this example, three types of blocks 111A, 111B and 111C are cut from a wafer 101. Referring to FIG. 20, the rows of slider sections extend in the lateral direction, and each of the rows is located on top or at the bottom of the adjacent one of the rows. The width of each of the blocks 111A, 111B and 111C is the length thereof in the lateral direction of the FIG. 20. Among the three types of blocks, the block 111A is the greatest, the block 111B is second greatest, and the block 111C is the smallest in width. Each of the blocks 111A, 111B and 111C includes slider sections arranged in a plurality of rows and has a specific width.

Figure 21:
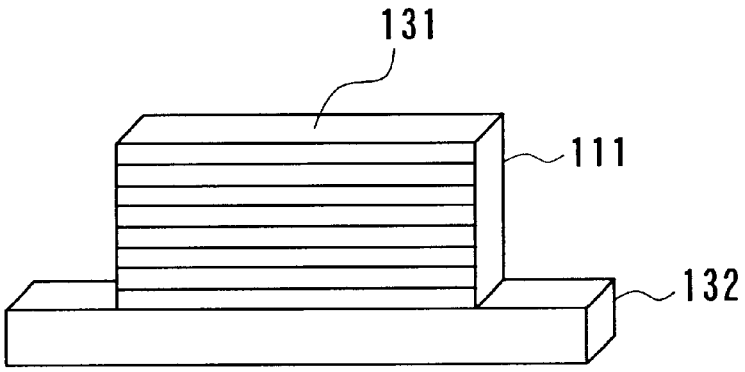
FIG. 21 is an illustration showing another step for manufacturing a slider in the embodiment of the invention.

Next, as shown in FIG. 21, an end face of the block 111 (representing the blocks 111A, 111B and 111C) opposite to an end face 131 where a surface to become a medium facing surface is exposed is bonded to a processing jig 132.

Figure 22:
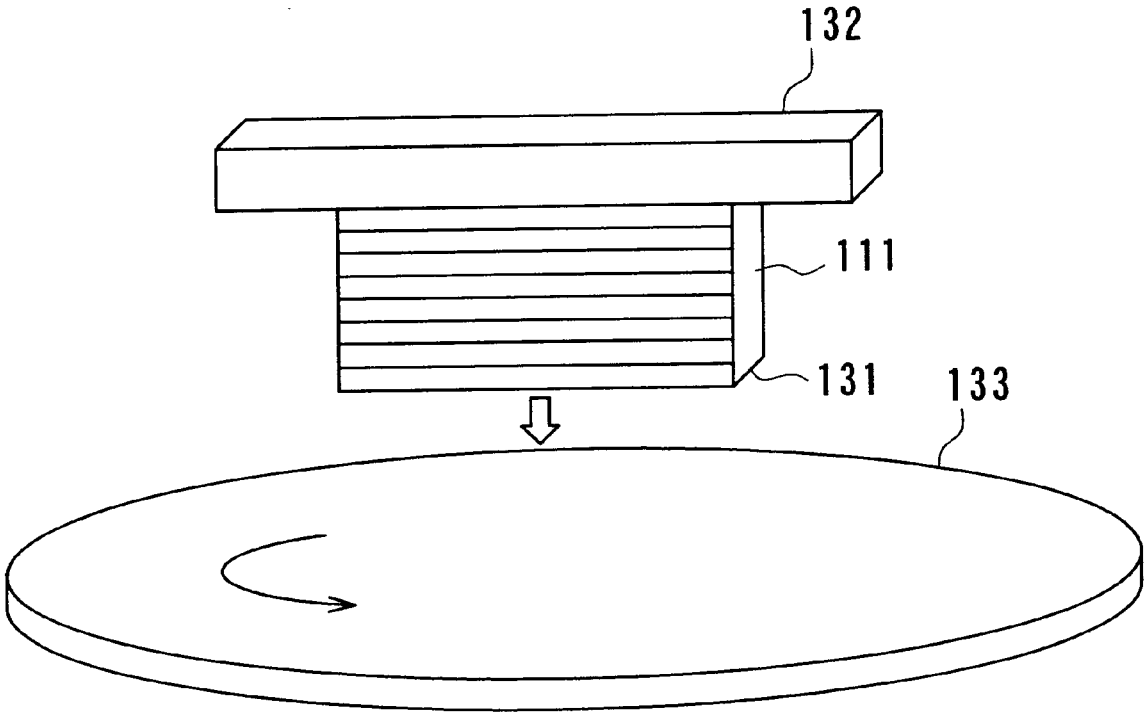
FIG. 22 is an illustration showing still another step for manufacturing a slider in the embodiment of the invention.

Then, as shown in FIG. 22, grinding using a grinding apparatus, lapping using a lapping apparatus 133 or the like is carried out on the end face 131, that is, the surface to become a medium facing surface, of the block 111 bonded to the jig 132. The MR height and the throat height are thereby defined accurately. The MR height is the length (height) between an end of an MR (magnetoresistive) element located in the medium facing surface and the other end. The throat height is the length (height) of the magnetic pole of an induction-type electromagnetic transducer between an end thereof located in the medium facing surface and the other end.

Figure 23:
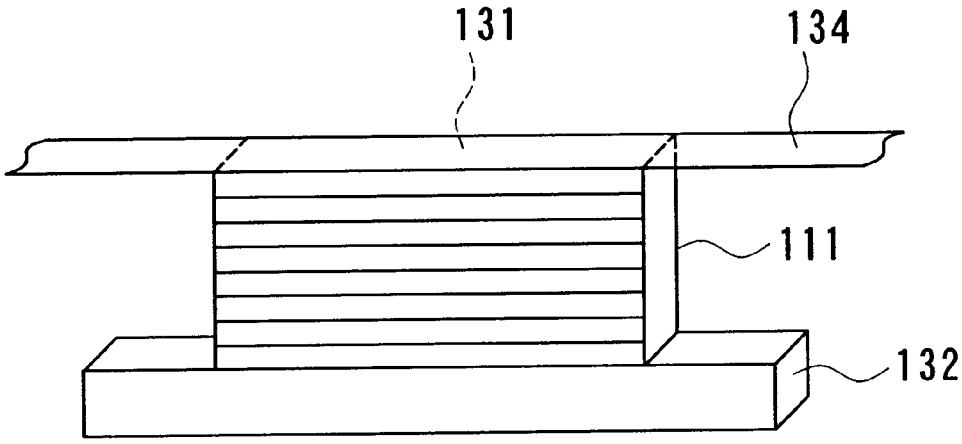
FIG. 23 is an illustration showing still another step for manufacturing a slider in the embodiment of the invention.

Next, as shown in FIG. 23, a protective member 134 is attached to the end face 131 in order to prevent the lapped end face 131 from being damaged or corroded.

Figure 24:
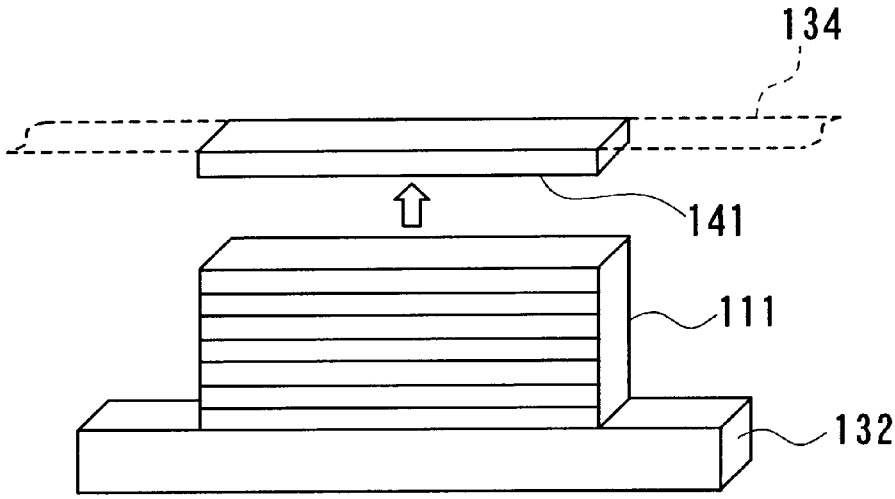
FIG. 24 is an illustration showing still another step for manufacturing a slider in the embodiment of the invention.

Next, as shown in FIG. 24, the block 111 is cut with acutting apparatus with the end face 131 covered with the protective member 134, such that a row of slider sections including the end face 131 is separated from the rest of the block 111. The row of slider sections thus separated from the block 111 is a bar 141 made up of the row of slider sections having received the processing. The processing of the surface to become a medium facing surface and cutting are repeated as long as the block 111 remains.

The protective member 134 is then cut into an appropriate size to become a protective member 21 as shown in FIGS. 5 and 6. The bar 141 becomes a workpiece 20 as shown in FIGS. 5 and 6. The back surface of the bar 141 (workpiece 20) is lapped by the processing apparatus according to the invention. Through this lapping, the final thickness of each slider and the profile of he medium facing surfaces are controlled.

Figure 25:
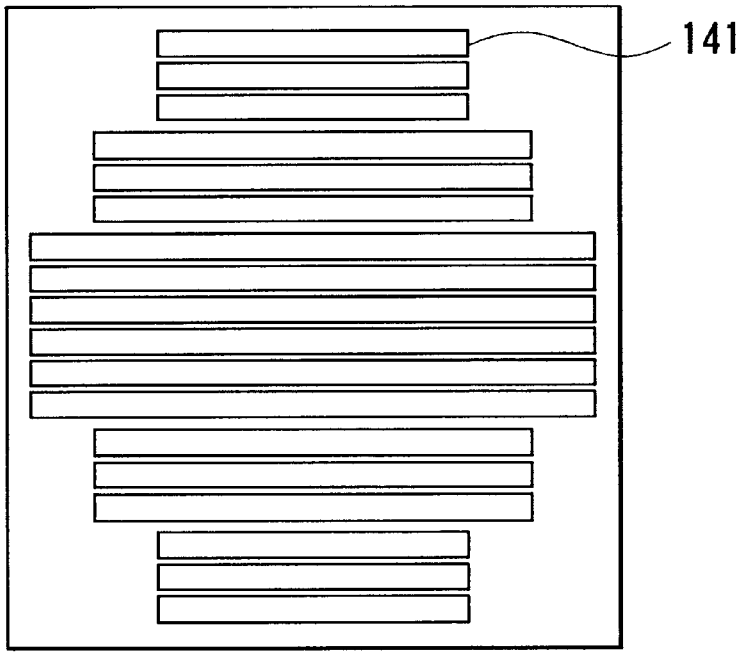
FIG. 25 is an illustration showing still another step for manufacturing a slider in the embodiment of the invention.

Next, as shown in FIG. 25, a plurality of bars 141 are aligned rows, and a photoresist pattern for etching is formed on the medium facing surfaces of the bars 141. The bars 141 are etched by dry etching using the photoresist pattern. Rail sections are thereby formed in the medium facing surfaces of the bars 141.

Figure 26:
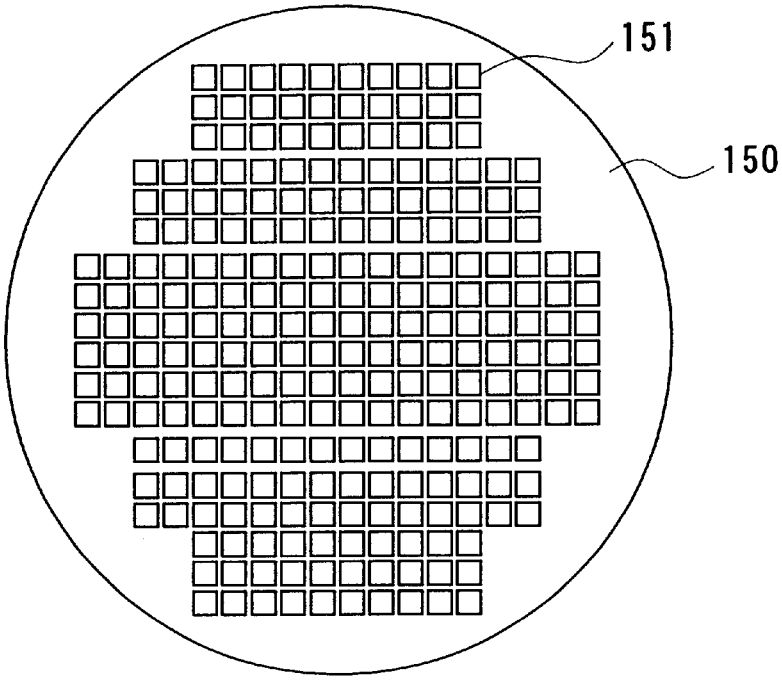
FIG. 26 is an illustration showing still another step for manufacturing a slider in the embodiment of the invention.

Next, as shown in FIG. 26, the bars 141 having the rail sections are aligned and an IC tape is attached thereto. The bars 141 are then cut by a cutting apparatus to obtain sliders 151.

As described above, with the processing apparatus or method according to the present embodiment, the absolute thickness of a workpiece is recognized, and a process is automatically performed such that the thickness of the workpiece becomes a predetermined value. This makes it possible to automatically process the workpiece such that it will have a desired thickness and to process the workpiece with high accuracy.

In the present embodiment, there is provided the reference position sensor 11 for detecting a reference position and the workpiece thickness sensor 12 for detecting a position associated with the thickness of a workpiece that changes as a result of a process. The absolute thickness of the workpiece is recognized based on information detected by both of the sensors 11 and 12. Therefore, the present embodiment makes it possible to easily recognize the absolute thickness of the workpiece by comparing the information detected by the sensors 11 and 12 without any unnecessary improvement of the accuracy of a machine control system, which consequently makes it possible to improve processing accuracy.

When processing time is controlled to provide a workpiece with a desired thickness, operating efficiency is low because a processing step and a measurement/evaluation step are repeated two or more times. On the contrary, according to the present embodiment, the efficiency of a processing operation can be improved because accurate recognition of the absolute thickess of a workpiece makes it possible to provide the workpiece with a desired thickness at one processing step. For example, the present embodiment makes it possible to improve the efficiency of a processing operation by 1.5 times or more (in other words, to reduce the time of the processing operation to ⅔ or less) when compared to the case in which the processing time is controlled.

According to the present embodiment, since there is no need for measuring and setting the thickness of a workpiece prior to a process, there is no possibility of occurrence of measuring and setting errors by an operator. Further, since the present embodiment eliminates the need for a measurement and evaluation step in the middle of a process, it is possible to prevent any reduction of quality attributable to electrostatic discharge (ESD), corrosion, etc.

According to the present embodiment, the two sensors 11 and 12 can be kept in a constant positional relationship whether the surface plate 3 is stopped or rotated because the two sensors 11 and 12 are attached to the same arm 5. This allows a further improvement of the accuracy of recognition of the absolute thickness of a workpiece and makes it possible to improve processing accuracy further.

Further, according to the present embodiment, since the back surface of a bar can be processed while the medium facing surface of the bar which is a workpiece 20 is covered with the protective member 21, it is possible to prevent the medium facing surface from being damaged or corroded.

According to the present embodiment, since the protective member 21 is sandwiched with the carrier 30 and keeper 7 to fix a workpiece 20 on the processing jig constituted by the carrier 30 and keeper 7, the workpiece 20 can be easily fixed on the processing jig to facilitate automation of the processing operation. In the present embodiment, since the attachment 7*b* that engages the lower end of the spline shaft 6 is provided at the keeper 7, the operation of coupling the spline shaft 6 and keeper 7 is facilitated, which also facilitates automation of the processing operation.

Moreover, in the present embodiment, since the protective member 21 having appropriate elasticity is interposed between the keeper 7 and a workpiece 20, the workpiece 20 and the surface plate 3 can be smoothly put into contact with each other even if the workpiece 20 is tapered because the protective member 21 absorbs the change in the thickness of the workpiece 20. In addition, since a greater load is applied to thicker part of the workpiece 20 through the protective member 21 compared to a thinner part, the taper of the workpiece 20 becomes smaller as the lapping of the workpiece 20 proceeds, which makes it possible to improve the parallelism of the workpiece 20. Variations of the thicknesses of a plurality of workpieces 20 fixed on a single processing jig can be reduced for the same reason.

Since the processing jig constituted by the carrier 30 and keeper 7 rotates on the surface plate 3, the degree of lapping of a workpiece 20 varies depending on the fixing position of the workpiece 20 on the processing jig. The wear of the surface plate 3 varies depending on the fixing position of the workpiece 20 on the processing jig, and the surface plate 3 will consequently have uneven degrees of wear depending on locations. Such unevenness deteriorates the profile of the surface to be lapped of a workpiece 20 and consequently deteriorates the profile of the medium facing surface that is a surface opposite to the lapped surface.

In the present embodiment, on the contrary, there are provided a plurality of types of carriers 30 which are different from each other in at least either the lengths or positions of the holes 30*c*. The position of the outermost ends of the holes, however, is uniformly set for the plurality of types of carriers 30. Therefore, the outermost ends of workpieces 20 draw substantially the same circular locus on the surface plate 3 even if the workpieces have different lengths. Consequently, the present embodiment makes it possible to perform a lapping operation on a plurality of types of workpieces 20 having different lengths under substantially the same conditions and to prevent occurrence of position-dependent differences in the degree of wear of the surface plate 3. Consequently, the present embodiment makes it possible to perform stable and accurate processing for a long period and to improve the accuracy of the profile of a medium facing surface. Further, the life of the surface plate 3 can be increased by about 1.5 times, for example.

Figure 27:
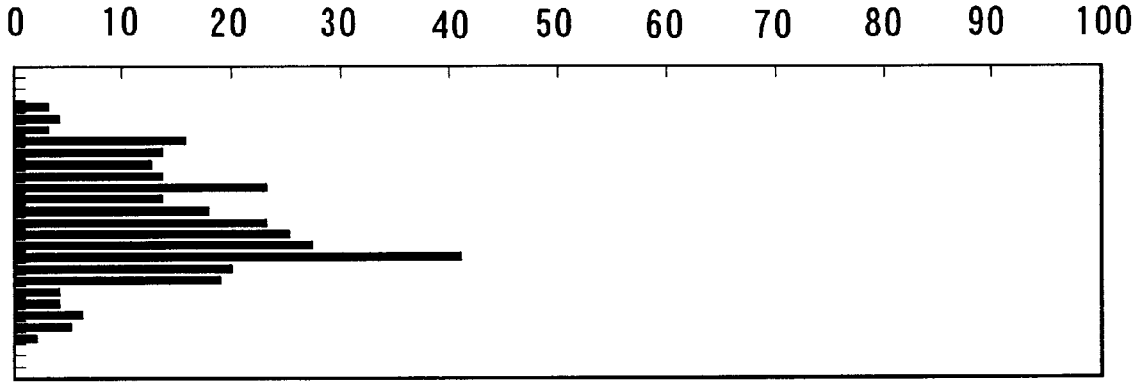
FIG. 27 is a distribution diagram showing an example of distribution of the thicknesses of a plurality of workpieces before a process using the processing apparatus according to the embodiment of the invention.
Figure 28:
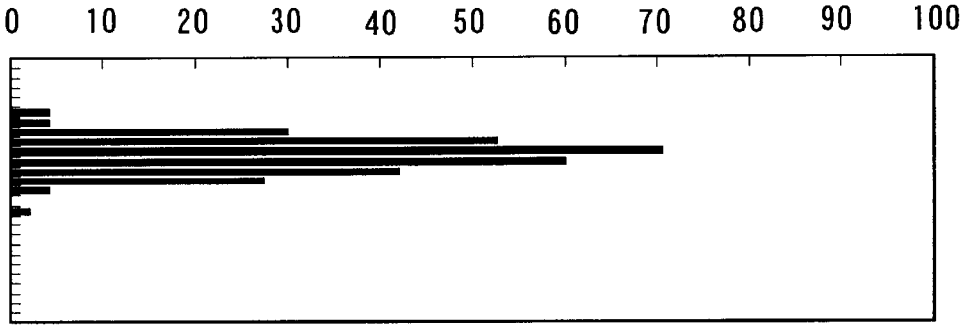
FIG. 28 is a distribution diagram showing an example of distribution of the thicknesses of the plurality of workpieces after the process using the processing apparatus according to the embodiment of the invention.

A description will now be made with reference to FIGS. 27 through 29 on a difference in distribution of thicknesses of workpieces before and after a process using the processing apparatus according to the present embodiment. FIG. 27 shows an example of distribution of the thicknesses of a plurality of workpieces before a process using the processing apparatus according to the present embodiment. FIG. 28 shows distribution of the thicknesses of the same plurality of workpieces after the process using the processing apparatus according to the embodiment. In FIGS. 27 and 28, the ordinate axis represents the thickesses of the workpieces, and the abscissa axis represents the number of workpieces. In the case of a process performed according to a conventional method in which processing time is controlled, the distribution of the thicknesses of the workpieces after the process is similar to that shown in FIG. 27.

Figure 29:
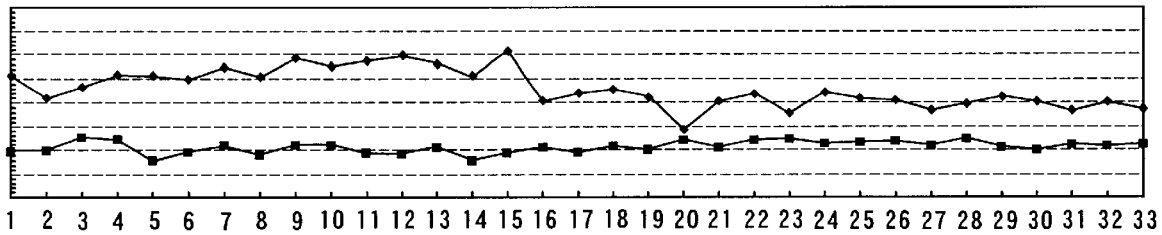
FIG. 29 is an illustration showing a comparison between the thicknesses of the plurality of workpieces before and after the process using the processing apparatus according to the embodiment of the invention.

FIG. 29 is an illustration showing a comparison between the thicknesses of the plurality of workpieces before and after the process using the processing apparatus according to the embodiment. In FIG. 29, the ordinate axis represents the thickesses of the workpieces, and the abscissa axis represents each of the workpieces. In FIG. 29, the dots in the upper part represent thicknesses before the process, and the dots in the lower part represent thicknesses after the process. It is apparent from FIGS. 27 through 29 that the processing apparatus according to the present embodiment can accurately process a workpiece such that the thickness of the workpiece becomes a desired value. According to the present embodiment, variation of thicknesses can be reduced to about one half of that in the case wherein processing time is controlled such that workpieces will have a desired thickness.

The present invention is not limited to the above described embodiment and may be modified in various ways. For example, each of the first detector and the second detector may have a plurality of sensors so as to identify the position from an average of values detected by the sensors.

As described above, in the apparatus or method for processing a thin-film magnetic head material according to the invention, a reference position is detected by the first detector; a position associated with the thickness of the material is detected by the second detector; and the thickness of the material is recognized based on the positions detected by the two detectors to control the processing machine such that the thickness of the material becomes a predetermined value. This makes it possible to improve the accuracy and efficiency of a polishing process on the thin-film magnetic head material.

According to the apparatus or method of the invention, the processing jig may hold the material having a band-shaped protective member applied to the surface opposite to the surface to be polished. It is thereby possible to polish the surface opposite to the medium facing surface of the material while protecting the medium facing surface.

According to the apparatus or method of the invention, a plurality of types of first members may be provided as the above-described first member, which are different from each other in at least either the length or position of the hole thereof, the position of the outermost end of the hole being uniformly set for the plurality of types of first members. It is thereby possible to perform a polishing process on a plurality of types of materials having different lengths under substantially the same conditions.

According to the apparatus or method of the invention, a plurality of types of processing jigs may be provided as the processing jig described above, each of which includes a position regulating section for placing a material in a predetermined position, the jigs being different from each other in at least either the length or position of the position regulating section thereof, and the position of the outermost end of the position regulating section thereof being uniformly set for the plurality of processing jigs. It is thereby possible to perform a polishing process on a plurality of types of materials having different lengths under substantially the same conditions.

According to the apparatus or method of the invention, the first detector and the second detector may be attached to the same arm. In this case, the first detector and the second detector are kept in a constant positional relationship. This allows an improvement of the accuracy of recognition of thickness of the thin-film magnetic head material and makes it possible to improve processing accuracy further.

According to the apparatus or method of the invention, the thickness of the material may be recognized based on the result of detection carried out plural times by the first detector and the second detector. It is thereby possible to recognize the thickness of the material with improved accuracy.

It is apparent from the above description that the present invention may be carried out in various modes and modifications. Therefore, the present invention may be carried out in modes other than the above-described best mode for carrying out the invention within the range of equivalence of the appended claims.

What is claimed is:

1. An apparatus for processing a thin-film magnetic head material comprising:

a processing machine which performs a polishing process on a thin-film magnetic head material in which sections to become sliders each including a thin-film magnetic head element are arranged in a row;

a first detector which detects a reference position;

a second detector which detects a position which changes depending on the thickness of the material; and a controller which recognizes the thickness of the material based on the reference position detected by the first detector and the position detected by the second detector and controls the processing machine such that the thickness of the material becomes a predetermined value.

2. The apparatus according to claim 1 wherein the processing machine has a rotating surface plate, the apparatus further comprising a processing jig for holding the material such that a surface of the material to be polished is put into contact with the surface plate.

3. The apparatus according to claim 2, wherein:

the processing jig holds the material having a band-shaped protective member applied to a surface thereof opposite to the surface to be polished; and the processing jig has: a first member having a hole at a lower end thereof, the hole allowing the material to pass therethrough and disallowing the protective member to pass therethrough; and a second member coupled to the first member, the first and second members sandwiching the protective member therebetween.

4. The apparatus according to claim 3, wherein the first member has a plurality of said holes.

5. The apparatus according to claim 3, wherein a plurality of types of first members are provided as said first member which are different from each other in at least either the length or position of said hole.

6. The apparatus according to claim 5, wherein the position of an outermost end of said hole is uniformly set for said plurality of types of first members.

7. The apparatus according to claim 2, wherein a plurality of types of processing jigs are provided as said processing jig, each of the processing jigs having a position regulating section for placing the material in a predetermined position, the jigs being different from each other in at least either the length or position of the position regulating section thereof, and the position of an outermost end of the position regulating section thereof being uniformly set for the plurality of types of processing jigs.

8. The apparatus according to claim 1, wherein the first detector and the second detector are mounted on the same arm.

9. The apparatus according to claim 1, wherein the first detector and the second detector intermittently perform the detecting operation.

10. The apparatus according to claim 1, wherein the controller recognizes the thickness of the material based on the result of detection carried out plural times by the first detector and the second detector.

11. A method for processing a thin-film magnetic head material utilizing an apparatus for processing a thin-film magnetic head material that has: a processing machine which performs a polishing process on a thin-film magnetic head material in which sections to become sliders each including a thin-film magnetic head element are arranged in a row; a first detector which detects a reference position; and a second detector which detects a position which changes depending on the thickness of the material, the method comprising the steps of:

detecting a reference position using the first detector and detecting a position which changes depending on the thickness of the material using the second detector;

recognizing the thickness of the material based on the reference position detected by the first detector and the position detected by the second detector; and performing the processing by controlling the processing machine based on the recognized thickness of the material such that the thickness becomes a predetermined value.

12. The method according to claim 11 wherein:

the processing machine has a rotating surface plate; and the material is held using a processing jig such that a surface of the material to be polished is put into contact with the surface plate in the step of performing the processing.

13. The method according to claim 12 wherein:

the processing jig holds the material having a band-shaped protective member applied to a surface thereof opposite to the surface to be polished; and the processing jig has: a first member having a hole at a lower end thereof, the hole allowing the material to pass therethrough and disallowing the protective member to pass therethrough; and a second member coupled to the first member, the first and second members sandwiching the protective member therebetween.

14. The method according to claim 13, wherein the first member has a plurality of said holes.

15. The method according to claim 13, wherein a plurality of types of first members are provided as said first member which are different from each other in at least either the length or position of said hole.

16. The method according to claim 15, wherein the position of an outermost end of said hole is uniformly set for said plurality of types of first members.

17. The method according to claim 12, wherein a plurality of types of processing jigs are provided as said processing jig, each of the processing jigs having a position regulating section for placing the material in a predetermined position, the jigs being different from each other in at least either the length or position of the position regulating section thereof, and the position of an outermost end of the position regulating section thereof being uniformly set for the plurality of types of processing jigs.

18. The method according to claim 11, wherein the first detector and the second detector are mounted on the same arm.

19. The method according to claim 11, wherein the detecting step intermittently detects the positions.

20. The method according to claim 11, wherein the recognizing step recognizes the thickness of the material based on the result of detection carried out plural times by the first detector and the second detector.

* * * * *